US009462899B2

(12) United States Patent
Bell

(10) Patent No.: US 9,462,899 B2
(45) Date of Patent: Oct. 11, 2016

(54) MAGNETIC CUSTOMIZABLE PICTURE FRAME SYSTEM

(71) Applicant: Stefanie Bell, Pardeeville, WI (US)

(72) Inventor: Stefanie Bell, Pardeeville, WI (US)

( * ) Notice: Subject to any disclaimer, the term of this patent is extended or adjusted under 35 U.S.C. 154(b) by 0 days.

(21) Appl. No.: 14/811,743

(22) Filed: Jul. 28, 2015

(65) Prior Publication Data

US 2016/0022059 A1 Jan. 28, 2016

Related U.S. Application Data

(60) Provisional application No. 62/029,929, filed on Jul. 28, 2014.

(51) Int. Cl.
*A47G 1/06* (2006.01)

(52) U.S. Cl.
CPC ..... *A47G 1/065* (2013.01); *A47G 1/0627* (2013.01); *A47G 2001/0666* (2013.01); *A47G 2001/0672* (2013.01)

(58) Field of Classification Search
CPC .. A47G 1/0616; A47G 1/0627; A47G 1/065; A47G 2001/0672
See application file for complete search history.

(56) References Cited

U.S. PATENT DOCUMENTS

| | | | |
|---|---|---|---|
| 5,303,488 | A | 4/1994 | Todd et al. |
| 6,010,338 | A | 1/2000 | Watson |
| 6,510,631 | B1 | 1/2003 | Baggarly |
| 6,688,029 | B1 | 2/2004 | Dunn |
| 7,114,278 | B2 | 10/2006 | Marks et al. |

*Primary Examiner* — Gary Hoge
(74) *Attorney, Agent, or Firm* — The Keys Law Firm PLLC

(57) ABSTRACT

A magnetic customizable picture frame for allowing a plurality of various frame designs to be selectively employed by a user includes a frame base having a rectangular shaped body with a perimeter groove and two receiving slots and an attachable cover having a rectangular body sized and shaped to fit over the frame base. Through its selective attachment to the frame base as well as its ability to removably receive one or more magnetic attachable embellishments, the attachable cover provides an interchangeable decorative surface for the magnetic customizable picture frame. Advantageously, the perimeter groove allows a plurality of frame bases to be selectively attached in series through the use of coupling members which include opposing tab members sized to engage the perimeter groove of adjacent frame bases.

6 Claims, 2 Drawing Sheets

MAGNETIC CUSTOMIZABLE PICTURE FRAME SYSTEM

CROSS REFERENCE TO RELATED APPLICATIONS

This application claims the benefit of and incorporates by reference U.S. provisional patent application Ser. No. 62/029,929 filed Jul. 28, 2014.

BACKGROUND OF THE INVENTION

1. Field of the Invention

This invention relates generally to border members for pictures and, more particularly, to picture frames having magnetically held customizable covers and embellishments.

2. Description of the Prior Art

The use of picture frames as decorative edging for a picture to make it more decorative, easier to display, or to provide protection is well known. A problem which still exists, however, conventional picture frames are typically of a single, fixed design, color, and construction. When it is desired to change the color, material, or design of such a frame to match the decoration in a new or redecorated room, it is typically required to simply get a new picture frame. Thus, there remains a need for a magnetic customizable picture frame system which allows a user to change the aesthetics of a picture frame though discrete, interchangeable covers. It would be helpful if such a magnetic customizable picture frame system additionally enabled customization through discrete, interchangeable embellishments. It would be additionally desirable for such a magnetic customizable picture frame system to enable a plurality of frames to be attached together through removably attachable connectors.

The Applicant's invention described herein provides for a magnetic customizable picture frame system adapted to allow a user to change the visible surface of a picture frame into one of a plurality of styles, materials, and/or colors. The primary components in Applicant's magnetic customizable picture frame system are a frame base, an attachable cover, and attachable embellishments. When in operation, the magnetic customizable picture frame system enables a single frame to take on the style, color and material of one of a plurality of interchangeable covers as desired by an end user. As a result, many of the limitations imposed by prior art structures are removed.

SUMMARY OF THE INVENTION

A magnetic customizable picture frame for allowing a plurality of various frame designs to be selectively employed by a user. The magnetic customizable picture frame includes a frame base having a rectangular shaped body with a perimeter groove and two receiving slots and an attachable cover having a rectangular body sized and shaped to fit over the frame base. Through its selective attachment to the frame base as well as its ability to removably receive one or more magnetic attachable embellishments, the attachable cover provides an interchangeable decorative surface for the magnetic customizable picture frame.

In some embodiments, a plurality of frame bases can be selectively attached in series through the use of coupling members defined by two compressible arms positioned in a crisscross orientation, with each including at their end opposing tab members sized to engage the perimeter groove of adjacent frame bases.

It is an object of this invention to provide a magnetic customizable picture frame system which allows a user to change the aesthetics of a picture frame though discrete, interchangeable covers.

It is another object of this invention to provide a magnetic customizable picture frame system which enabled customization through discrete, interchangeable embellishments.

It is yet another object of this invention to provide a magnetic customizable picture frame system which enables a plurality of frames to be attached together through removably attachable connectors.

These and other objects will be apparent to one of skill in the art.

DETAILED DESCRIPTION OF THE INVENTION

Figure 1:
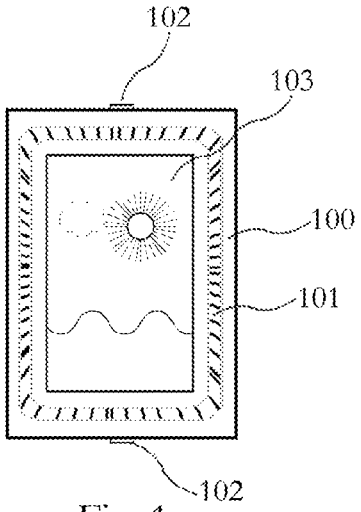
FIG. 1 is a front elevational view of the frame base of a magnetic customizable picture frame system built in accordance with the present invention.
Figure 2:
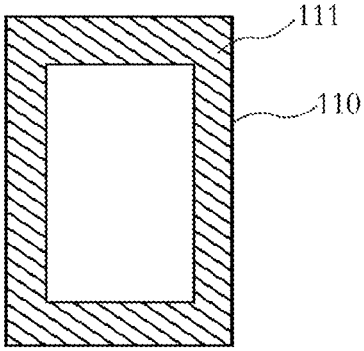
FIG. 2 is a front elevational view of an attachable cover of a magnetic customizable picture frame system built in accordance with the present invention.
Figure 3A:
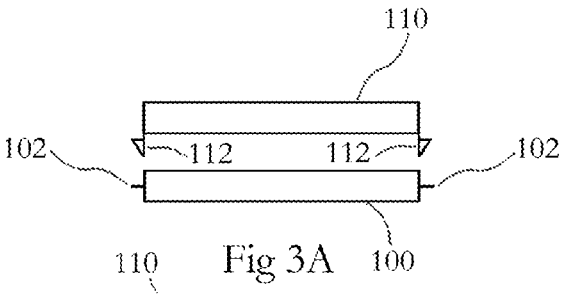
FIG. 3A is a side elevational view of a magnetic customizable picture frame system built in accordance with the present invention with the frame base and attachable cover separated.
Figure 3B:
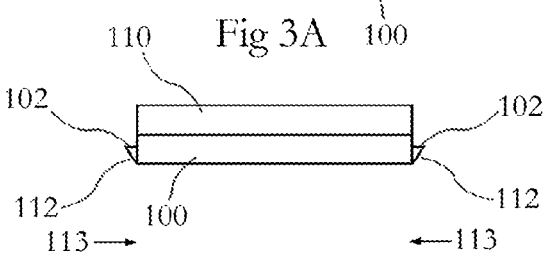
FIG. 3B is a side elevational view of a magnetic customizable picture frame system built in accordance with the present invention with the frame base and attachable cover together.
Figure 4:
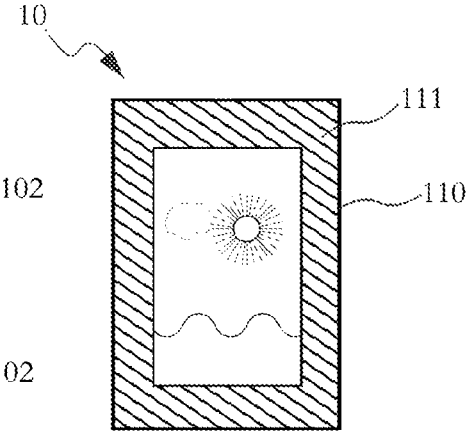
FIG. 4 is a front elevational view of a magnetic customizable picture frame system built in accordance with the present invention assembled with an attachable cover.

Referring now to the drawings and in particular FIG. 1, a frame base 100 of a magnetic customizable picture frame is shown having a rectangular shaped body with a perimeter groove 101 and two receiving slots 102. It is contemplated that the frame base 100 can be is sized and shaped as conventional picture frames are, and thus while shown as rectangular it is understood that it could be constructed in any conventional picture frame shaped. The perimeter groove 101 is defined by a contiguous recess in the front surface of the frame base 100. The receiving slots 102 are each flange receiving members which form the receiving member of a flange fastener used to attach an attachable cover built in accordance with the present invention as described below. The frame base 100 is configured to receive pictures 103 in the same manner in which conventional frames are and is shown with a picture 103 inserted therein. In addition, it is contemplated that the rear surface of the frame base 100 may be constructed to include any convention frame mounted structure to enable the frame base to be mounted on a wall or to stand on a surface.

Referring now to FIGS. 2, 3A, 3B, and 4, an attachable cover 110 is shown as a rectangular body sized and shaped to fit over the frame base 100 built in accordance with the present invention. The attachable cover 110 includes a decorative surface 111 defining its front surface. It is contemplated that the specific style, material, and/or color of the decorative surface 111 for different attachable covers 110 may vary in accordance with the present invention; such would be necessary for different attachable covers 110 to provide varying aesthetics as contemplated by the present invention.

The attachable cover additionally includes two flange fasteners 112 disposed on its rear surface at its upper and lower end. The flange fasteners 112 are shaped to engage the receiving slots 102 on the frame base 100 when the rear surface of the attachable cover 110 is pressed against the front surface of the frame base 100. Once the flange fasteners 112 have engaged the receiving slots 102, the attachable cover 110 is locked to the frame base 100.

While the attachable cover 110 is locked to the frame base 100, the decorative surface 111 is held in place around any picture 103 in place in the frame base 100. To remove the attachable cover 110 from the frame base 100, a user must exert force in an internal direction 113, bending the flange fasteners in the same direction, and then move the attachable cover away from the frame base 100. Once on attachable cover 110 is removed, another attachable cover 110, having a different style, material, and/or color, can be positioned in the same manner in its place, enabling the magnetic customizable picture frame 10 to assume a different style, material, and/or color by simply interchanging attachable covers 110.

In addition to the flange fastening system, it is contemplated that the frame base 100 and attachable cover may be constructed to include magnetic material, providing redundancy in the fastening aspect.

Figure 5:
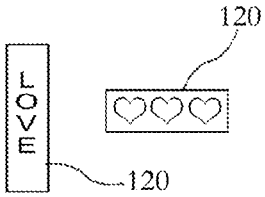
FIG. 5 is a front elevational view of attachable embellishments of a magnetic customizable picture frame system built in accordance with the present invention.
Figure 6:
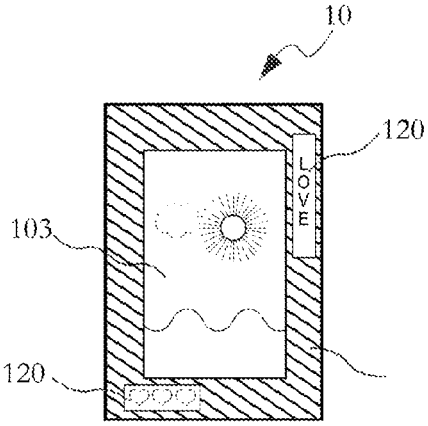
FIG. 6 is a front elevational view of a magnetic customizable picture frame system built in accordance with the present invention assembled with an attachable cover and attachable embellishments.
Figure 7:
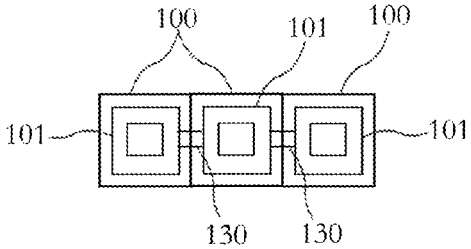
FIG. 7 is a front elevational view of a magnetic customizable picture frame system built in accordance with the present invention with three base frames connected.
Figure 8A:
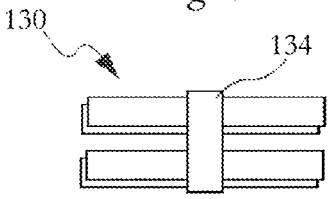
FIG. 8A is a top plan view of a frame connecter of a magnetic customizable picture frame system built in accordance with the present invention in the closed position.
Figure 8B:
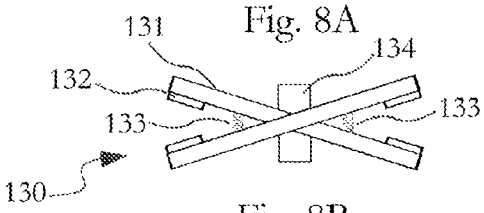
FIG. 8B is a side elevational view of a frame connecter of a magnetic customizable picture frame system built in accordance with the present invention in the open position
Figure 8C:
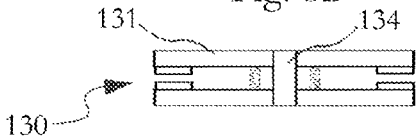
FIG. 8C is a side elevational view of a frame connecter of a magnetic customizable picture frame system built in accordance with the present invention in the closed position.

Referring now to FIGS. 5 and 6, discrete attachable embellishments 120 are defined as magnetic bodies which are selectively attachable to the front surface of the attachable cover 110. The front surface of some styles of attachable covers 110 include magnetic material; thus enabling the selective and removable attachment of one or more magnetic attachable embellishments 120. In this regard, the selective and removable attachment of one or more magnetic attachable embellishments 120 enables further customization of the aesthetics of the magnetic customizable picture frame 10.

Referring now to FIGS. 7, 8A, 8B, and 8C, a plurality of frame bases 100 built in accordance with the present invention are selectively attachable through the use of coupling members 130. Each coupling member 130 is defined by two compressible arms 131 positioned in a crisscross orientation, with each including at their end opposing tab members 132. The tab members 132 are sized to engage the perimeter groove 101 of a frame base 100 built in accordance with the present invention. In this regard, the tab members 132 on one side of the coupling member 130 can engage the perimeter groove 101 of a first frame base 100, with the tab members 132 on the other side of the coupling member 130 engaging the perimeter groove 101 of a second frame base 100, and so on, removably connecting the first frame base 100 and second frame base 100. The coupling members 130 operate as spring loaded snap lock clamps, and include springs 133 disposed between adjacent arms 131 on each side of a snap lock 134.

It is contemplated that once a plurality of frame bases 100 have been connected as desired, each frame base 100 may then be covered with an attachable cover and, if desire, one or more attachable embellishments.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A magnetic customizable picture frame, comprising:

a frame base having a planar body with a flat front frame surface, wherein said frame base includes a perimeter groove defining a continuous recess in the front frame surface and at least one frame engaging section; and an attachable cover defining a cover body having a front cover surface and back surface and sized and shaped to fit over the frame base so as to completely obscure the front frame surface, wherein said attachable cover includes at least one cover engaging section configured to releasably engage the at least one frame engaging section when the back surface is placed against to front frame surface.

2. The magnetic customizable picture frame of claim 1, additionally comprising at least one discrete attachable embellishment which is selectively attachable to the front cover surface.

3. The magnetic customizable picture frame of claim 2, wherein said attachable cover and said at least one discrete attachable embellishments are configured such that the at least one discrete attachable embellishments are magnetically attachable to the front cover surface.

4. The magnetic customizable picture frame of claim 1, wherein each of said at least one frame engaging sections defines a receiving slots and each of said at least one cover engaging sections defines a flange fastener.

5. The magnetic customizable picture frame of claim 1, wherein said frame base includes at least one frame engaging section extending from at least two opposing edges of the planar body and said attachable cover includes at least one cover engaging section extending from at least two opposing edges thereof.

6. The magnetic customizable picture frame of claim 5, wherein each of said at least one frame engaging sections defines a receiving slots and each of said at least one cover engaging sections defines a flange fastener.

* * * * *